US006612924B1

(12) United States Patent
Mantyla et al.

(10) Patent No.: US 6,612,924 B1
(45) Date of Patent: Sep. 2, 2003

(54) PASSIVE VENTING DEVICE

(75) Inventors: James Mantyla, Barrie (CA); Nicholas Broeders, Innisfil (CA)

(73) Assignee: Canplas Industries, LTD, Barrie (CA)

( * ) Notice: Subject to any disclaimer, the term of this patent is extended or adjusted under 35 U.S.C. 154(b) by 0 days.

(21) Appl. No.: 10/074,134

(22) Filed: Feb. 12, 2002

(30) Foreign Application Priority Data

Feb. 11, 2002 (CA) ..... 2371455

(51) Int. Cl.[7] ..... F24F 7/02
(52) U.S. Cl. ..... 454/367; 454/366
(58) Field of Search ..... 454/136, 194, 454/366, 367, 368

(56) References Cited

U.S. PATENT DOCUMENTS

| | | | | | |
|---|---|---|---|---|---|
| 2,784,736 | A | * | 3/1957 | Chmid et al. | 137/504 |
| 3,871,844 | A | * | 3/1975 | Calvin, Sr. | 55/306 |
| 4,297,818 | A | * | 11/1981 | Anderson | 52/199 |
| 4,803,816 | A | * | 2/1989 | Klober | 52/219 |
| 4,817,506 | A | | 4/1989 | Cashman | |
| 4,903,445 | A | | 2/1990 | Mankowski | |
| 5,005,328 | A | * | 4/1991 | Holtgreve | 52/199 |
| 5,402,611 | A | * | 4/1995 | Vagedes | 52/198 |
| 5,561,952 | A | * | 10/1996 | Damron | 52/198 |
| 5,591,080 | A | * | 1/1997 | Ward | 454/359 |
| 5,791,985 | A | * | 8/1998 | Schiedegger et al. | 454/339 |
| 6,155,008 | A | | 12/2000 | McKee | |
| 2001/0049261 | A1 | * | 12/2001 | McKee et al. | 454/367 |

* cited by examiner

*Primary Examiner*—Harold Joyce
(74) *Attorney, Agent, or Firm*—Hoffmann & Baron, LLP

(57) ABSTRACT

A passive venting device for venting a building comprising a base comprising (1) a vent structure for permitting gases to pass in and out of the building; (2) an attachment structure coupled to the vent structure for attaching the device; and (3) a gas-permeable screen sized, shaped and positioned to prevent objects from passing through said vent structure, and having an airflow-enhancing configuration for providing greater airflow area than screens of ordinary sloped configuration; and a cover mountable to the base so as to cover the vent structure and permit the free flow of gas. The gas-permeable screen is spaced from the attachment structure in a direction vertically away the roof.

21 Claims, 6 Drawing Sheets

PASSIVE VENTING DEVICE

CROSS-REFERENCE TO RELATED APPLICATIONS

This application claims priority from Canadian Application No. 2,371,455, which was filed Feb. 11, 2002.

FIELD OF THE INVENTION

This invention relates generally to the field of venting devices, and in particular, to passive venting devices.

BACKGROUND OF THE INVENTION

Virtually all buildings and enclosures where human activity takes place require venting of one type of another. The type of venting device employed will depend on the kind of enclosure to be vented. For example, bathrooms containing showers typically have active vents with fans to vent steam to the outdoors. Kitchens, particularly in restaurants and hotels, similarly have powered vents for removing odours, smoke and steam to the outdoors.

Other types of enclosures, such as attics and yard sheds, do not require active venting. However, such enclosures do typically require a passive vent to allow for air flow from the enclosure to the atmosphere. Such venting is required, for example, to prevent a buildup of moisture in the enclosure. Passive vents do not include a mechanism for forcing air out of the enclosure. Rather, they simply include a vent structure in the form of an air conduit which allows airflow. Passive vents are well-known and have been extensively used in the past.

An important feature of passive vents is their airflow area. The effectiveness of such a vent is related to the speed with which air can flow through the vent, and thus, to the airflow area. The more air flows through the vent, the faster moisture levels and temperature levels are equalized inside and outside the enclosure, thus preventing, for example, harmful condensation inside the enclosure.

Because passive vents simply allow air to flow in and out through an opening in the enclosure, they typically include a screen that blocks animals or unwanted objects from entering the enclosure through the opening, but still allows air flow. The presence of the screen tends to reduce airflow area because the screen elements block some of the area through which air could flow in order to prevent objects or animals from entering into the enclosure.

Passive vents may be required on a variety of different surfaces, such as level roofs or sloped roofs. In the case of steeply sloped roofs, water will flow down the slope at a high rate of speed. One problem that can arise in such a circumstance is that water flowing quickly down the sloped roof encounters the vent and splashes into the vent structure. This problem is particularly likely to occur during heavy rainfall, which would produce heavy water flow down the sloped roof. Similar heavy water flow might occur, for example, when snow and ice on the roof begin to melt. A related problem is that, during times of heavy precipitation, raindrops can hit the roof and bounce into the vent structure. Thus, for vents used on such surfaces, it is desirable to construct the vent so as to prevent water from entering the vent structure.

U.S. Pat. No. 4,903,445 discloses a roof ridge vent having flaps attached at a pivot point to allow use of the vent on roof ridges of different angles. The vent includes two screens having an ordinary sloped configuration, i.e. the screens do not extend flat across the opening in the roof, but instead slope upward away from the opening. However, this device suffers from the problem of being limited to use on roof ridge openings. It is also complex and expensive to manufacture, assemble and install.

U.S. Pat. No. 4,817,506 teaches a roof vent for disposition along a roof ridge. The vent includes a sheet-like cover having an inverted V-shaped cross-section, and a plurality of spaced partitions for supporting baffles, which baffles are also used for attaching the vent to the roof.

This device suffers from the problem of being limited to use on roof ridges. It is large and unwieldy, as well as complex and expensive to manufacture and install.

U.S. Pat. No. 6,155,008 discloses a passive venting device having an attachment flange, a vent structure and a cover for covering the vent structure. Also included is a screen for preventing objects from passing into the vent structure. Though the vent is substantially rectangular, the screen is a five-sided shape in plan view. Thus, the screen has five screen sections corresponding to the five sides of the screen. However, this screen has an ordinary sloped straight-line configuration wherein the screen extends over the vent structure opening in an upward sloped direction and in a straight line away from the roof.

SUMMARY OF THE INVENTION

Therefore, what would be desirable is a passive venting device, suitable for use at a variety of different locations on a roof, which preferably provides increased airflow to and from the enclosure being vented and is simple and inexpensive to manufacture and install.

Accordingly, the present invention is directed to a passive venting device for venting a building enclosure to an outside, the device comprising:

a base member comprising (1) a vent structure for permitting gases to pass in and out of said building enclosure through an opening in a surface of said building enclosure and through said vent structure; (2) an attachment structure connected to said vent structure for attaching said device to said surface such that said opening is in fluid communication with said vent structure; and (3) a gas-permeable screen, said screen being sized, shaped and positioned to prevent objects from passing through said vent structure, said screen having an airflow-enhancing configuration for providing greater airflow area than screens of ordinary sloped configuration; and a cover member mountable to said base member so as to cover said vent structure and permit the free flow of gas through said vent structure;

wherein said gas-permeable screen is positioned such that, when said attachment structure is attached to said surface, all of said screen has a vertical displacement from said attachment structure.

BRIEF DESCRIPTION OF THE DRAWINGS

Reference will now be made, by way of example only, to drawings of the invention, which illustrate the preferred embodiment of the invention, and in which.

DETAILED DESCRIPTION OF THE PREFERRED EMBODIMENTS

Figure 1:
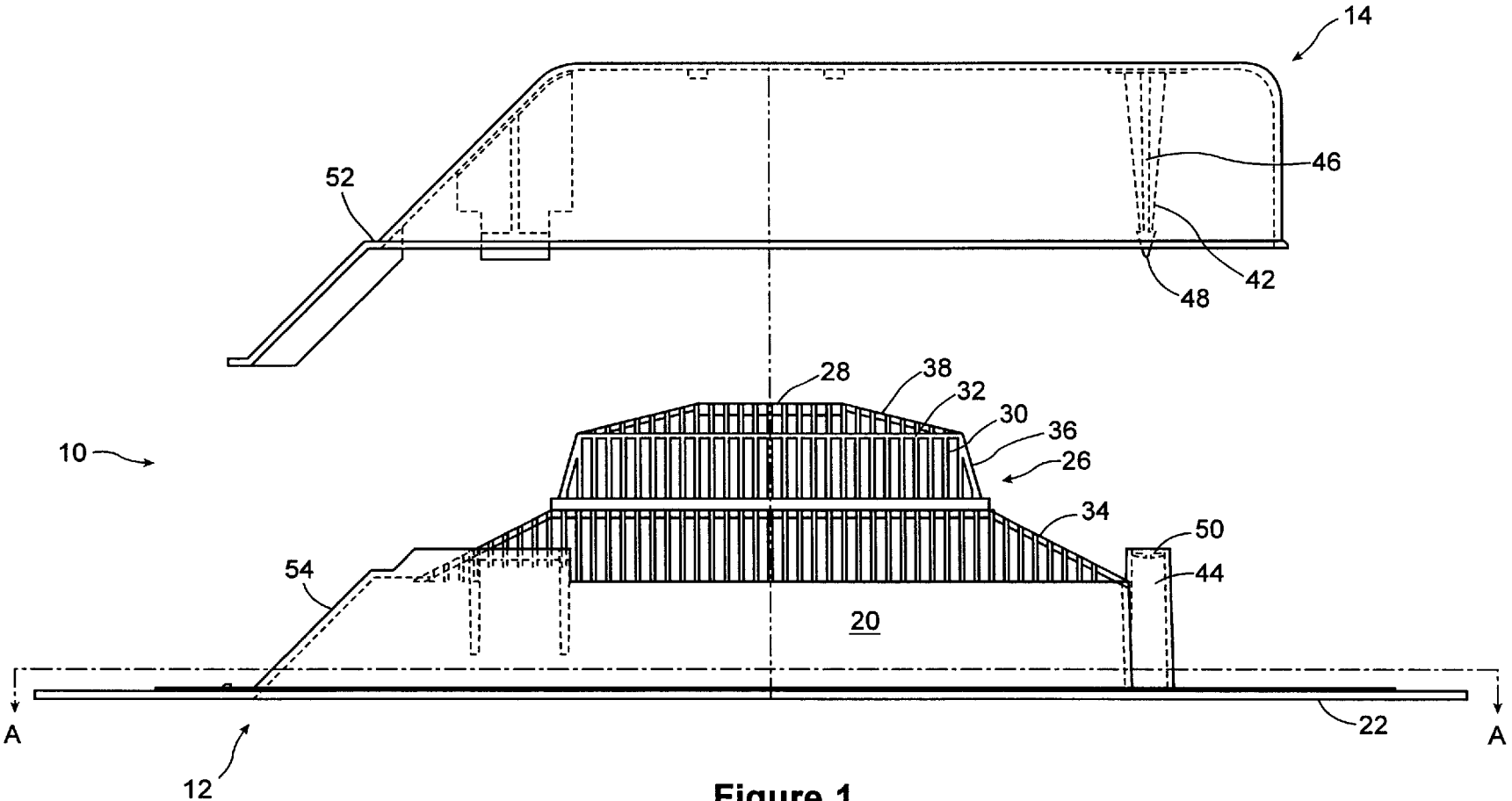
FIG. 1 is a side exploded view of the passive venting device.

FIG. 1 shows a passive venting device 10 for venting a building enclosure according to the present invention.

Figure 5:
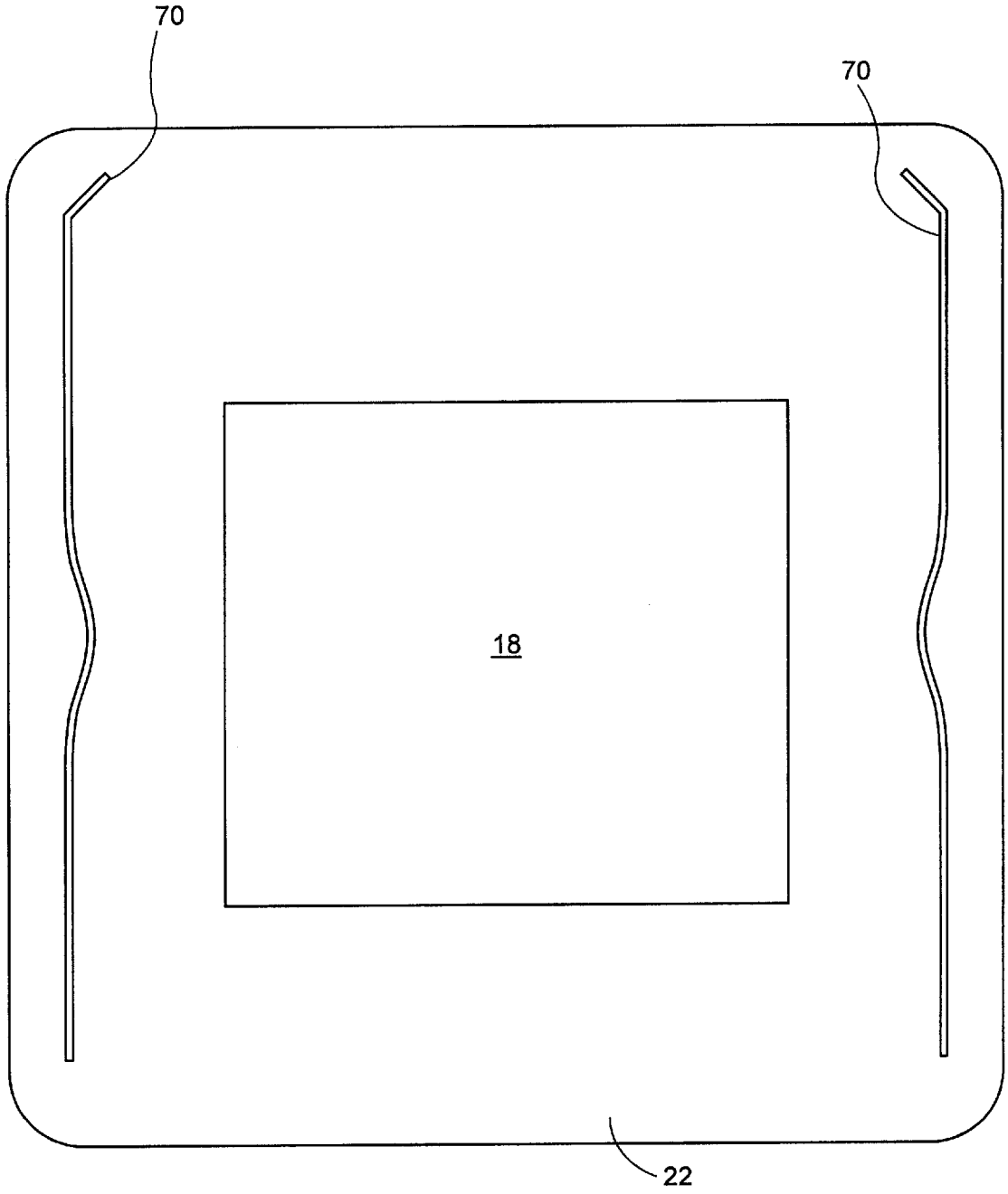
FIG. 5 is a cross-sectional view along line A—A of FIG. 1.
Figure 6:
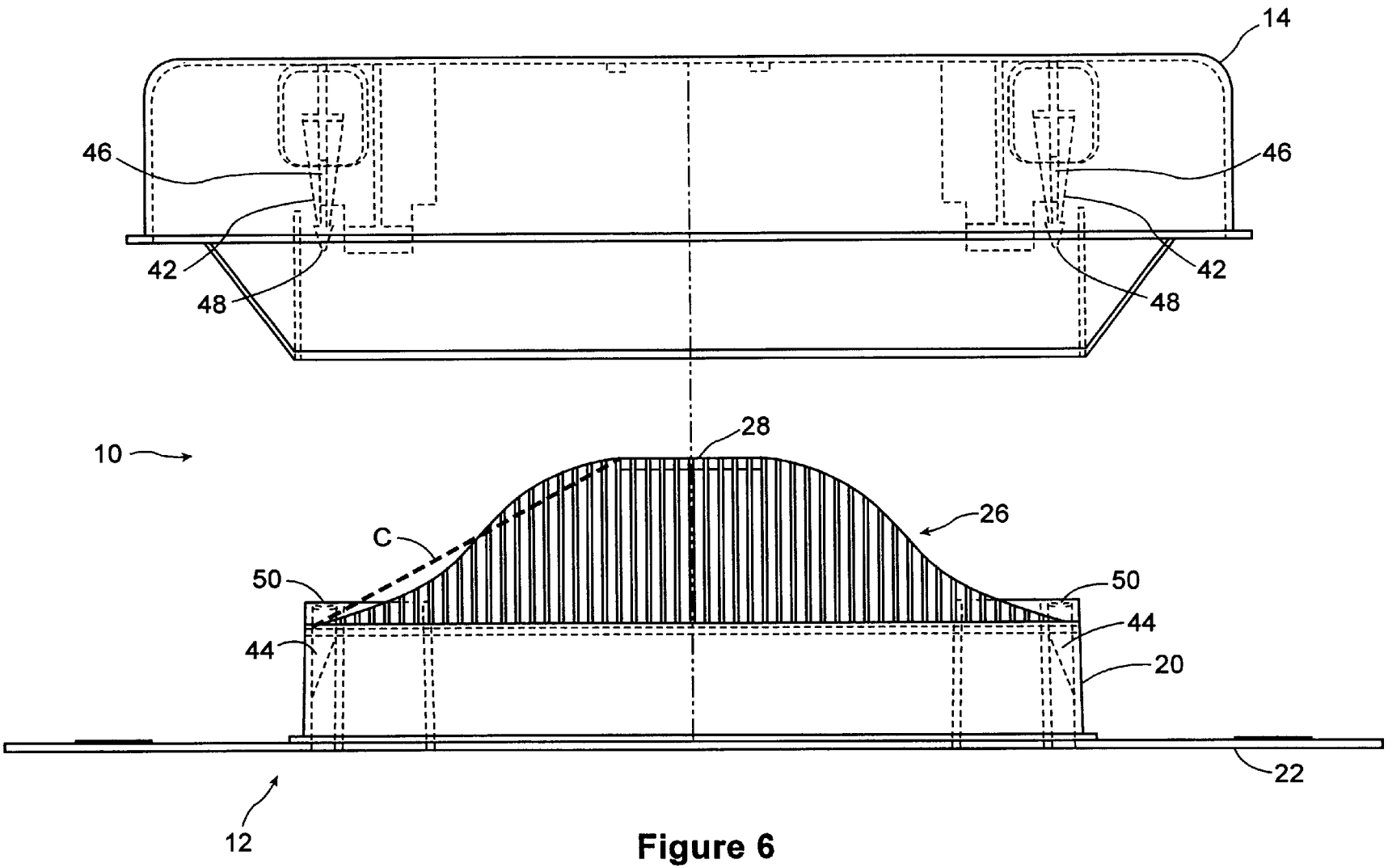
FIG. 6 is a second embodiment of a front exploded view of the passive venting device.

The passive venting device 10 comprises a base member 12 and a cover member 14. The base member 12 includes a vent structure which in the preferred embodiment comprises an aperture 18 and an aperture-surrounding wall 20 (see, FIG. 5). The vent structure is for permitting gases to pass in and out of the building enclosure through an opening in a surface of the building enclosure and through the aperture 18.

It will be appreciated by those skilled in the art that any vent structure which allows air to flow from the enclosure to the outside is comprehended by the present invention. However, it is preferable that the aperture 18 be positioned within the aperture-surrounding wall 20. It will be appreciated that in such a configuration, the top end of the aperture 18 is spaced vertically from the roof. As a result, the wall 20 presents a barrier to water flowing along the roof and prevents it from entering the aperture 18. Instead water flowing along the roof would simply deflect off of the wall 20 and flow away from the device 10. It will further be appreciated that spacing the aperture 18 from the roof reduces the amount of rain that can bounce off the roof, under the cover 14 and into the aperture 18. This is because the aperture 18 is further from the roof, so bouncing raindrops have further to travel to enter the aperture 18.

The base member 12 also includes an attachment structure connected to the vent structure for attaching the base member to the surface, typically a roof, such that the opening in the surface is in fluid communication with the aperture 18. In the preferred embodiment, the attachment structure comprises an outer flange 22. The outer flange 22 may be secured to the surface in any convenient manner, including using clips, nails or screws.

For the purposes of this specification,the word "horizontal" means parallel to the flange 22, and/or the roof or other surface to which the device 10 is attached. The word "vertical" denotes the direction extending orthogonally out of the "horizontal" roof or other surface.

Furthermore, it will be appreciated that the outer flange 22 which extends away from the aperture-surrounding wall 20 as shown, permits shingles to be lapped over the device, so that the device can be readily attached to a shingled roof in a manner that prevents water from leaking under the shingles.

Figure 3:
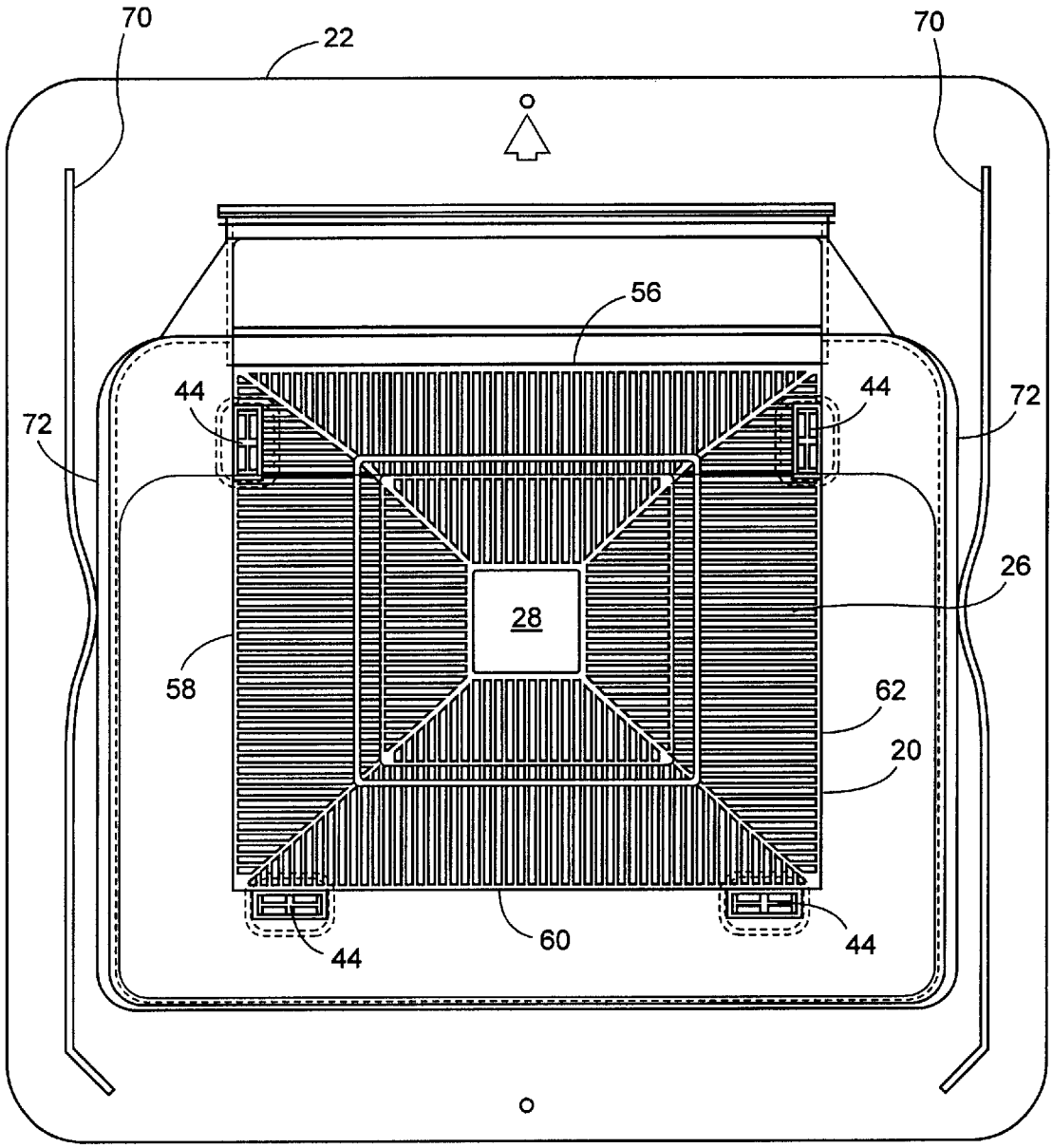
FIG. 3 is a top view of the passive venting device with the cover member shown as transparent.
Figure 4:
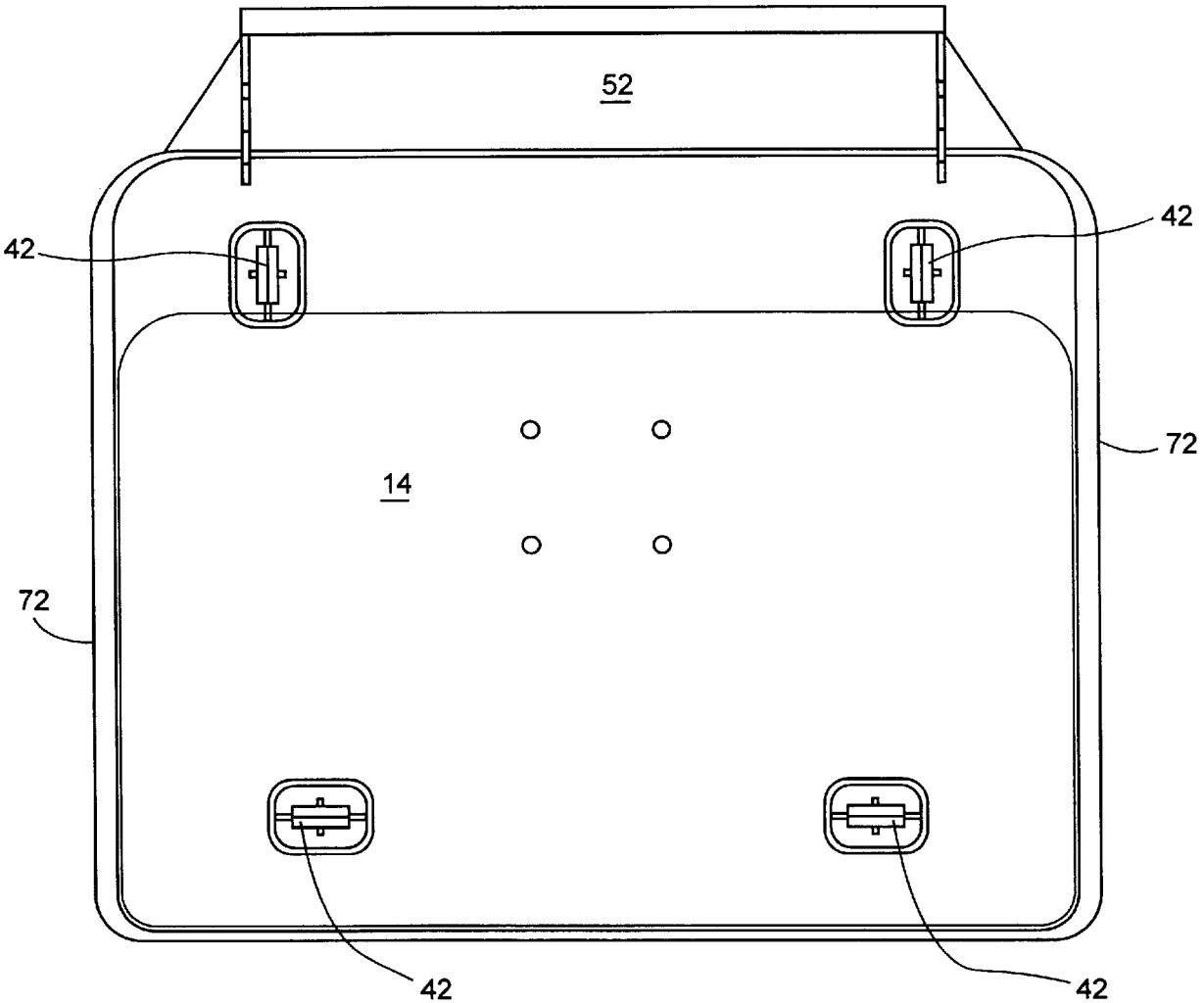
FIG. 4 is a plan view of the underside of the cover member.

The base member 12 further includes a gas permeable screen 26, preferably extending from the aperture-surrounding wall 20 to the cover-supporting member 28 (see FIG. 3). As shown in FIG. 3, the cover-supporting member 28 is preferably not gas permeable and does not form part of the screen 26. The screen 26 extends around the aperture-surrounding wall 20. In the embodiment shown in FIG. 3, the screen 26 is rectangular in plan view, and thus has four screen sections 56, 58, 60, 62 corresponding to each side of the rectangle. In embodiments where the screen 26 has a different shape in plan view, the screen would typically have a screen section corresponding to each side of the shape. It will be appreciated that the screen can have any number of screen sections, but must have at least one.

The screen 26 is sized, shaped and positioned to prevent objects from passing through the aperture 18 into the enclosure being vented. Therefore, the screen 26 preferably screens the entire area between the aperture-surrounding wall 20 and the cover-supporting member 28, thus ensuring that unwanted objects cannot pass through the screen 26 into the aperture 18.

The screen 26 preferably comprises of vertical screen members 30 and horizontal screen members 32. In combination, the vertical and horizontal screen members 30 and 32 form the screen 26 which provides relatively small spaces between the screen members. Thus, unwanted objects such as birds, animals or debris are prevented from entering the aperture 18, whereas air, water vapour or any other gas can flow through the spaces between the screen members 30 and 32.

Figure 2:
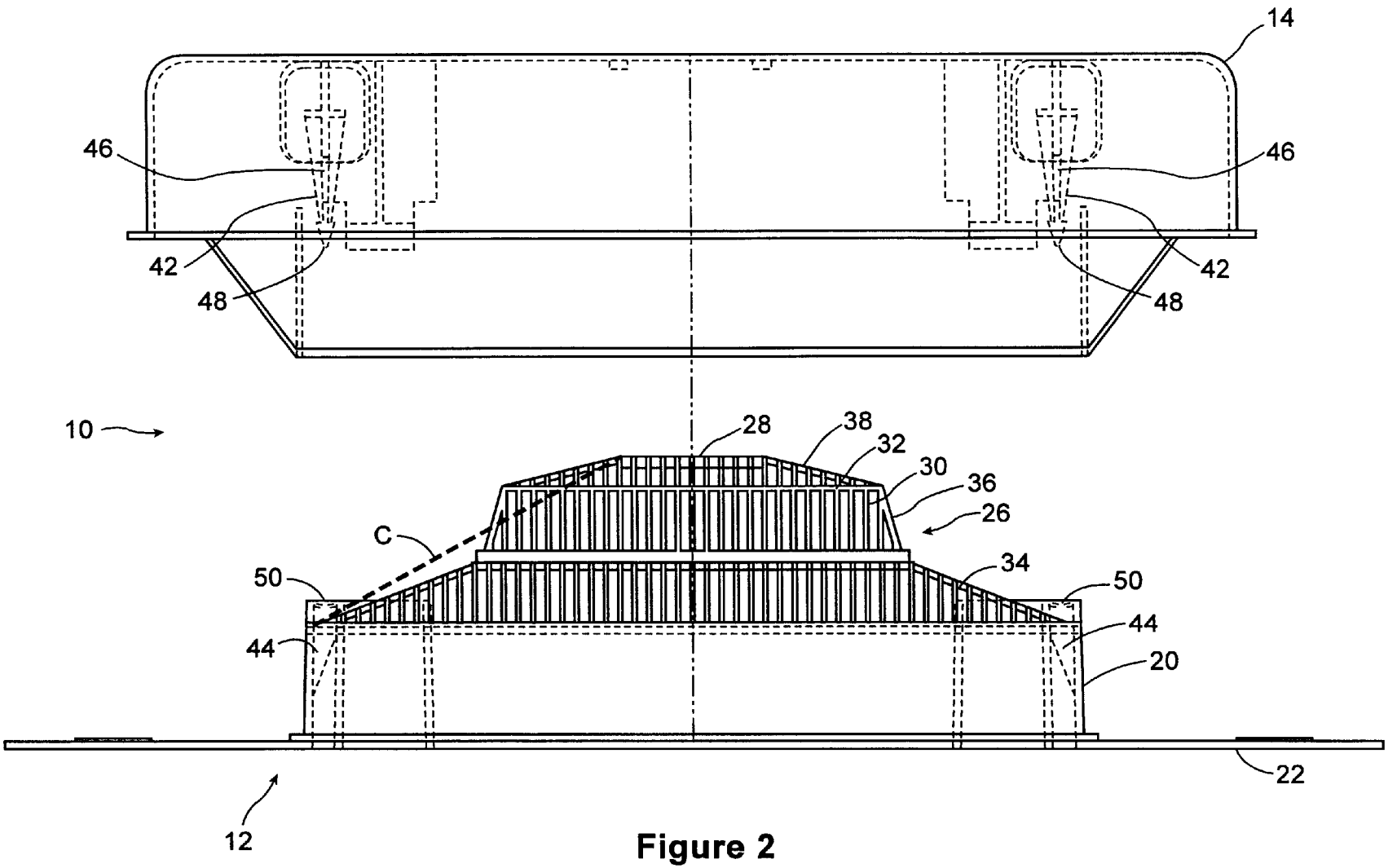
FIG. 2 is a front exploded view of the passive venting device.

As shown in FIGS. 1, 2 and 3, the screen 26 preferably includes a first step 34, a second step 36 and a third step 38. The first step 34 extends diagonally upward from the aperture-surrounding wall 20. The second step 36 extends upward from the first step 34, but at a steeper upward angle than the first step 34. The third step 38 extends upward from the upper end of the second step 36, but at a more gradual angle (i.e. closer to the horizontal) than the second step 36. The third step 38 extends to the cover-supporting member 28. Thus, the preferred screen 26 includes three step formations. It will be appreciated that a "step" thus comprises a portion of the screen which extends in a direction having a non-zero vertical component to it.

The thick diagonal dotted line designated by the reference character "C" in FIG. 2 shows the hypothetical position of a conventional, ordinary sloped straight-line screen configuration (not part of this invention) extending upward in a straight sloped line from the aperture-surrounding wall 20 to the cover supporting member 28. It will be appreciated by those skilled in the art that the screen 26 of the present invention has an airflow-enhancing configuration for providing greater air flow area than screens of the ordinary sloped straight-line configuration. In the ordinary sloped straight-line configuration, the screen sections of the screen 26 extend directly, in a straight line, over the aperture 18; in cases where there is an aperture-surrounding wall 20 and a cover-supporting member 28, the screen extends directly, in a straight line, from the aperture-surrounding wall 20 to the cover-supporting member 28. The surface area of the screen 26 is thus minimized, because the distance travelled by the screen between the aperture-surrounding wall 20 and the cover-supporting member 28 is minimized, as shown by line C. By contrast, in the present invention, the use of a three step configuration increases the distance travelled by the screen 26 between the aperture-surrounding wall 20 and the cover-supporting member 28. Thus, the surface area of the screen 26 is increased, and greater air flow area is achieved.

It will be appreciated by those skilled in the art that the presence of the screen members 30, 32 has the effect of reducing the available air flow area, as air can only flow between those members. Thus, by increasing the surface area of the screen 26, more space between the screen members 30, 32 is created, and thus, air flow area is increased. This, in turn, enhances air flow.

It will be appreciated by those skilled in the art that the invention comprehends airflow-enhancing configurations other than a three step configuration. For example, the screen 26 could include only two steps, or could include a rounded or "wave" configuration in which the screen 26 has a sinusoidal or other wave-like shape as it covers the aperture 18. What is important for the airflow-enhancing configuration is that the screen have a configuration which provides greater airflow area than screens of ordinary sloped straight-line configuration, preferably having a profile other than a straight line profile as the screen extends upward away from the roof.

It will be appreciated by those skilled in the art that the aperture-surrounding wall 20 also acts as a screen spacer. That is, it spaces all of the screen 26 vertically away from the flange 22 and the roof. When the device 10 is positioned on an intermediate portion of a sloped roof (i.e. between the roof ridge or apex and the roof edge), spacing the screen 26 away from the roof helps to prevent flowing water or rain from entering under the cover 14 and leaking through the aperture 18.

The cover member 14 is mountable to the base member 12 so as to cover the aperture 18 while permitting the free flow of gas therethrough between the outside and the enclosure. The cover member 14 may be mountable to the base member 12 in any secure fashion. Examples include screws, nails, clips, glue, sonic welding or heat staking. In the preferred embodiment, the cover member 14 is mounted by attachment means in the form of four clips, with each clip including an attachment member 42 and an attachment receptacle 44. Each amendment member 42 includes at least one shaft 46 and at least one attachment head 48. The attachment heads 48 have the shape of flat arrow heads. As used herein, the phrase "arrow head" or variants thereof refer to a sagittate-shaped member having a first thick end and an opposed thinner or apical end with a tapered or chevron-shaped edge therebetween.

The attachment receptacle 44 includes locking tabs 50. In operation, the attachment heads 48 are inserted into the attachment receptacles 44. The locking tabs 50 flex open so as to admit the attachment member 42 into the receptacle 44. Once the head 48 has been inserted beyond the tab 50, the tab 50, being biased toward a closed position, closes in around the shaft 46. Because of the shape of the head 48, the tab 50 catches the head 48 at its upper end and is adapted to grip the head 50 inside the receptacle 44. Thus, the head 50 cannot be withdrawn from the receptacle 44.

It will be appreciated by those skilled in the art that the attachment means need not comprise this specific structure. Any attachment means which firmly secures the cover member 14 to the base member 12 while permitting the free flow of gas will suffice. For example, the cover member 14 could be glued or screwed to the base member 12. Also, other locking mechanisms besides tabs could be used, and other shapes for the heads 48 besides an arrow head shape are possible. Similarly, it would be possible to use a different number of clips, heads or shafts. What is important is that the base member 12 and the cover member 14 are firmly secured one another.

In the preferred embodiment, the tabs 50 are sized and shaped to cover substantially the entire width of the receptacle 44. The purpose of this design is to make the tabs 50 resistant to the leakage of water into the receptacle 44. When the attachment member 42 has been inserted into the attachment receptacle 44, the surface of attachment receptacle 44 is substantially covered, and thus making it resistant to the entry of rain water.

The preferred embodiment of the device further includes waterdeflecting means comprising a cover barrier 52 and a base barrier 54 that registers with the underside of the cover barrier 52. The water deflecting means are intended for use in a situation where the device 10 is mounted on a sloped roof having an upward side and a downward side. The water-deflecting means is designed to provide additional protection against liquid flowing down the sloped roof from entering the vent structure 16. It will be appreciated that the cover barrier 52 provides a slanted wall extending toward the flange 22 which prevents water from entering under the cover member 14. Thus, most preferably, the preferred device 10 will be used on sloped roofs and will be installed with the barrier 52 facing up the slope.

It will be appreciated by those skilled in the art that the invention comprehends devices 10 without the water-deflecting means described above. Rather, devices 10 having no water-deflecting means or other water deflecting means are also comprehended.

As shown in FIG. 3, the flange 22 includes a rain ridge 70 thereon. The flange 22 is sized and shaped so as to allow the shingles to be lapped over the flange-22 during installation. This design is intended to permit the flat flange 22 to function similarly to a shingle and prevent water leakage into the roof. However, in conditions of heavy rain, for example, rain falling onto the outer flange 22 might sometimes work its way under shingles which are lapped over the outer flange 22. The rain ridge 70 is designed to direct such water toward the side of the device 10 which faces the downward side of the sloped roof, where the flange 22 is lapped over the shingles. In this way, the water would be discharged off of the flange 22 on top of the shingles, thus preventing water from entering underneath the shingles.

The device 10 preferably also includes a rain interceptor in the form of a lip 72 projecting substantially horizontally from the edge of the cover member 14. As mentioned above, when it is raining, it is possible for rain to hit the flange 22 and bounce up under the cover member 14 and into the aperture 18. It will be appreciated that the lip 72 is sized, shaped and positioned to intercept raindrops that pass adjacent to the edge of the cover 14 from which the lip 72 extends. It will further be appreciated that raindrops falling adjacent to the edge of the cover member 14 are the ones most likely to bounce up into the aperture 18. Thus, the lip 72 acts as a rain interceptor for intercepting-rain that may bounce up into the aperture 18.

The lip 72 may be positioned on all or any portion of the cover 14. However, the lip 72 is preferably positioned at least on the two sides of the cover member 14 which are designed to be facing sideways on a sloped roof (i.e. not up or down the slope). In a device 10 without the cover barrier and base barrier, the lip 72 may also be positioned on the upward-facing side of the cover member 14.

Most preferably, the lip 72 extends approximately 5/16 of an inch from the cover 14. It has been found that a lip 72 of this size provides substantial protection from rain entering the aperture 18 while maintaining the device 10 at a sufficiently compact size. However, it has also been found that the lip 72 provides some protection for inhibiting rain from entering the aperture 18 if it is at least 1/8 of an inch in width.

While the foregoing embodiments of the present invention have been set forth in considerable detail for the purpose of making a complete disclosure of the invention, it will be apparent to those skilled in the art that various modifications can be made to the device without departing from the broad scope of the invention as defined in the attached claims. Some of these variations are discussed above and others will be apparent to those skilled in the art. For example, the airflow enhancing configuration can be any configuration which provides more airflow area than an ordinary straight-line sloped screen configuration. What is considered important in the present invention is to provide a simple device which preferably provides enhanced airflow area.

We claim:

1. A passive venting device for venting a building enclosure to an outside, the device comprising:

a base member comprising (1) a vent structure for permitting gases to pass in and out of said building enclosure through an opening in a surface of said building enclosure and through said vent structure; (2) an attachment structure connected to said vent structure for attaching said device to said surface such that said opening is in fluid communication with said vent structure; and (3) a gas-permeable screen, said screen being sized, shaped and positioned to prevent objects from passing through said vent structure, said screen having an airflow-enhancing configuration for providing greater airflow area than screens of ordinary straight-line sloped configuration, said airflow-enhancing configuration including at least two step formations in said screen; and a cover member mountable to said base member so as to cover said vent structure and so as to permit the free flow of gas between the outside and the enclosure through said vent structure;

wherein said gas-permeable screen is positioned such that, when said attachment structure is attached to said surface, all of said screen has a vertical displacement from said attachment structure.

2. The passive venting device of claim 1, wherein said screen includes three step formations.

3. The passive venting device of claim 1, said base member further comprising a cover-supporting member, and wherein said screen extends from said vent structure to said cover-supporting member.

4. The passive venting device of claim 1, said device further comprising attachment means for attaching said cover member to said base member, said attachment means comprising:

an attachment member attached to said cover member;

an attachment receptacle, in said base member, for receiving said attachment member;

said attachment member and said attachment receptacle being sized and shaped such that said attachment member is gripped within the attachment receptacle after being inserted into said attachment receptacle.

5. The passive venting device of claim 4, said attachment member including a head, said attachment receptacle including a locking tab adapted to admit said head into said attachment receptacle and to prevent said head from being withdrawn therefrom.

6. The device of claim 1, said device further comprising a rain interceptor extending substantially horizontally from said cover member, the interceptor being sized, shaped and positioned to intercept rain passing adjacent to said cover member.

7. The device of claim 1, said device further comprising a rain interceptor extending substantially horizontally from the cover member, the interceptor being sized, shaped and positioned to intercept rain passing adjacent to the cover member.

8. The device of claim 7, the interceptor comprising a lip, at least a portion of the lip being at least ⅛ of an inch in width.

9. The device of claim 7, wherein the cover member is substantially rectangular in plan view, and wherein the interceptor is positioned on at least two opposite sides of the cover member.

10. The device of claim 8, wherein the lip is approximately 5/16 of an inch in width.

11. The device of claim 1, the attachment structure including a substantially flat outer flange sized and shaped to permit shingles to be lapped thereover.

12. The device of claim 11, further comprising a rain ridge sized, shaped, and positioned on the flange, so as to direct water that is under the shingles out from under the shingles and down a slope.

13. The device of claim 1, wherein the cover member carries a barrier for blocking water from entering under the cover.

14. A passive venting device for venting a building enclosure to an outside, the device comprising:

a base member comprising (1) a vent structure for permitting gases to pass in and out of said building enclosure through an opening in a surface of said building enclosure and through said vent structure; (2) an attachment structure connected to said vent structure for attaching said device to said surface such that said opening is in fluid communication with said vent structure; and (3) a gas-permeable screen, said screen being sized, shaped and positioned to prevent objects from passing through said vent structure, said screen having an airflow-enhancing configuration for providing greater airflow area than screens of ordinary straight-line sloped configuration, said airflow-enhancing configuration including a rounded configuration of said screen; and a cover member mountable to said base member so as to cover said vent structure and so as to permit the free flow of gas between the outside and the enclosure through said vent structure;

wherein said gas-permeable screen is positioned such that, when said attachment structure is attached to said surface, all of said screen has a vertical displacement from said attachment structure.

15. The device of claim 14, wherein said rounded configuration includes a wave-like shape.

16. The device of claim 15, wherein said wave-like shape is a sinusoidal shape.

17. The passive venting device of claim 14, said base member further comprising a cover-supporting member, and wherein said screen extends from said vent structure to said cover-supporting member.

18. The device of claim 14, said device further comprising a rain interceptor extending substantially horizontally from the cover member, the interceptor being sized, shaped and positioned to intercept rain passing adjacent to the cover member.

19. The device of claim 14, the attachment structure including a substantially flat outer flange sized and shaped to permit shingles to be lapped thereover.

20. The device of claim 19, further comprising a rain ridge sized, shaped, and positioned on the flange, so as to direct water that is under the shingles out from under the shingles and down a slope.

21. The device of claim 14, wherein the cover member carries a barrier for blocking water from entering under the cover.

* * * * *